US005878451A

United States Patent [19]

Lumine

[11] Patent Number: 5,878,451

[45] Date of Patent: Mar. 9, 1999

[54] BOX SPRING WITH PLASTIC BAND SUPPORT FOR MATTRESS

[76] Inventor: Rafael Kerpache Lumine, Calle Auyantepuy Edif. El Parral PH-12 Colinas Bello Moute, Caracas, Venezuela

[21] Appl. No.: 719,469

[22] Filed: Sep. 25, 1996

[51] Int. Cl.[6] ..... A47C 19/02; A47C 7/14

[52] U.S. Cl. ..... 5/191; 5/186.1; 297/452.63; 297/452.64

[58] Field of Search ..... 5/186.1, 191, 192, 5/194, 286, 400; 297/452.63, 452.64

[56] References Cited

U.S. PATENT DOCUMENTS

| | | | |
|---|---|---|---|
| T101,501 | 2/1982 | Robinson | 5/186.1 |
| 2,788,531 | 4/1957 | Dye et al. | 5/191 |
| 3,147,495 | 9/1964 | Farstrup | 5/191 |
| 3,491,384 | 1/1970 | Hero et al. | 5/191 |
| 3,590,901 | 7/1971 | Dubinsky | 297/452.63 |
| 3,636,574 | 1/1972 | Kramer | 5/186.1 |
| 3,719,962 | 3/1973 | Buckley | 5/191 |
| 3,724,402 | 4/1973 | Thyberg et al. | 297/452.64 |
| 3,737,926 | 6/1973 | Hermanson | 5/191 |
| 3,751,110 | 8/1973 | Shaw | 5/191 |

FOREIGN PATENT DOCUMENTS

| | | | |
|---|---|---|---|
| 47087 | 9/1936 | France | 5/191 |

*Primary Examiner*—Brian K. Green
*Assistant Examiner*—Robert G. Santos
*Attorney, Agent, or Firm*—Thomas S. Hahn

[57] ABSTRACT

Box spring with plastic band support for mattress consisting of a frame (1) and a set of bands (2) made of extruded plastic positioned one by one so as to enclose the frame (1), tightened mechanically under a specific tension and joined at their ends by heat sealing, the majority of the bands being arranged transversely on the frame (1) but with some bands longitudinally arranged and interlaced with the former.

3 Claims, 2 Drawing Sheets

FIG. 4
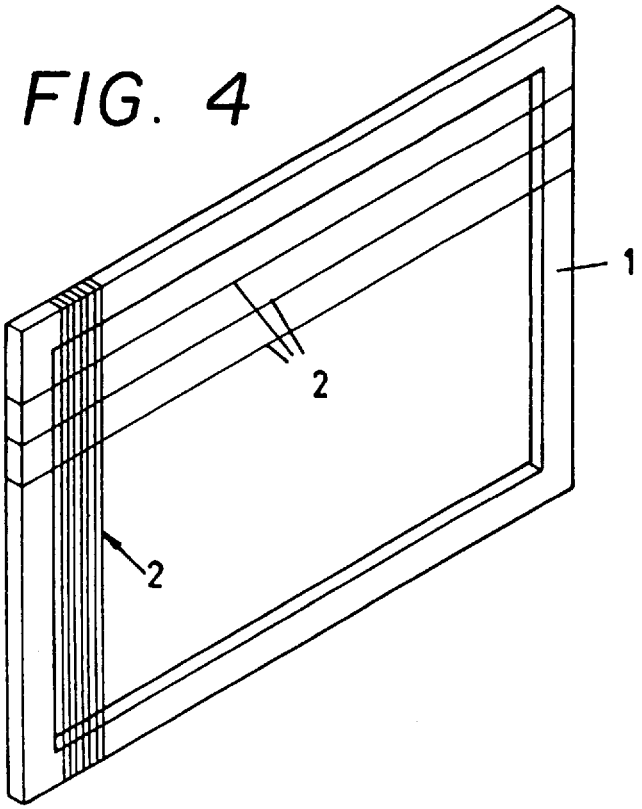
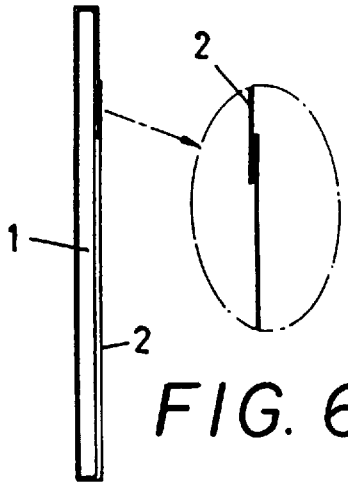
FIG. 6
FIG. 5
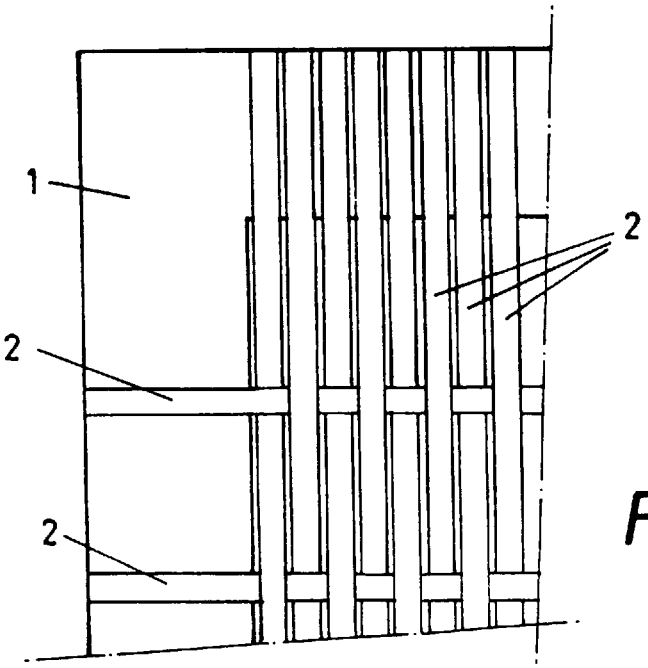
FIG. 7

BOX SPRING WITH PLASTIC BAND SUPPORT FOR MATTRESS

BACKGROUND OF THE INVENTION

Traditional box springs based on braided wires and springs as a means of support for a mattress in beds have the disadvantage that with use the metal of the wires loses its tempering and the springs are stretched, with the result that the center of the bed sags and there are accompanying problems in the form of discomfort and deformation of the spinal column which users may suffer as a consequence.

Solutions of various kinds have been developed in order to resolve the problem. For example, rigid plates are incorporated or the support is based on semiflexible foams of special materials, but this gives rise to other disadvantages, discomfort, and high cost. In addition, such solutions are suitable only for design of mattresses of a specific consistency and thickness, but not, for example, for thin soft sponge mattresses, since the reduced absorptivity of such mattresses results in excessive discomfort with these support means.

One practical solution to this problem has been the production of mattresses integrated with box springs, but the use of these box springs alone is disadvantageous, in that they generally are used with an additional mattress placed on top. The bed then becomes very bulky and inelegant in appearance.

SUMMARY OF THE INVENTION

A new box spring is now proposed in accordance with this invention, one whose structural embodiment is based on design and functional characteristics that make this box spring particularly advantageous by providing an effective and practical solution to the problems referred to above.

This box spring claimed for the invention consists basically of a structural frame, preferably of metal tubing atop which are a number of plastic bands covering the entire surface, bands of a material highly resistant to deformation but characterized by a certain amount of flexibility. These bands are mounted under tension, each of the bands being looped and its ends being joined by heat sealing.

A box spring is thereby obtained which has a continuous surface but is characterized by a certain amount of flexibility, so that the box spring is suitable for any type of mattress, including thin mattresses of low consistency, since the softening and rigidity defects of these mattresses are fully offset by the inherent characteristics of this box spring.

The absence of surface hollows from the box spring also causes the mattresses to remain free of local deformations which might cause them to deteriorate, in that the nondeformability of the support surface provides unvarying comfort in use, along with optimum healthful conditions.

In view of all the foregoing, it follows that this box spring claimed for the invention possesses highly advantageous characteristics which take on a life of their own and it assumes a preferential position from the viewpoint of its function as a support for the mattresses for which it has been designed.

BRIEF DESCRIPTION OF THE DRAWINGS

FIG. 4 is another perspective view of the frame (1) of the box spring with part of the surface covering bands (2) installed.

FIG. 5 is a cross-sectional view of the frame (1) showing the mounting of the surface covering bands (2) in question.

FIG. 6 illustrates in greater detail closure by means of overlapping union and sealing of the ends of each band (2).

FIG. 7 is an enlarged plan view of one of the comers of the frame (1) illustrating the arrangement of the bands (2).

DETAILED DESCRIPTION OF THE INVENTION

Explanatory details

Figure 2:
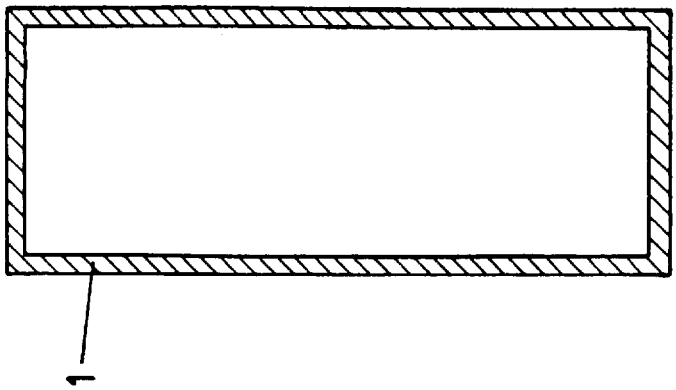
FIG. 2 is a detailed view corresponding to an enlarged section of one of the panels of the frame in question (1) as indicated in FIG. 1.
Figure 1:
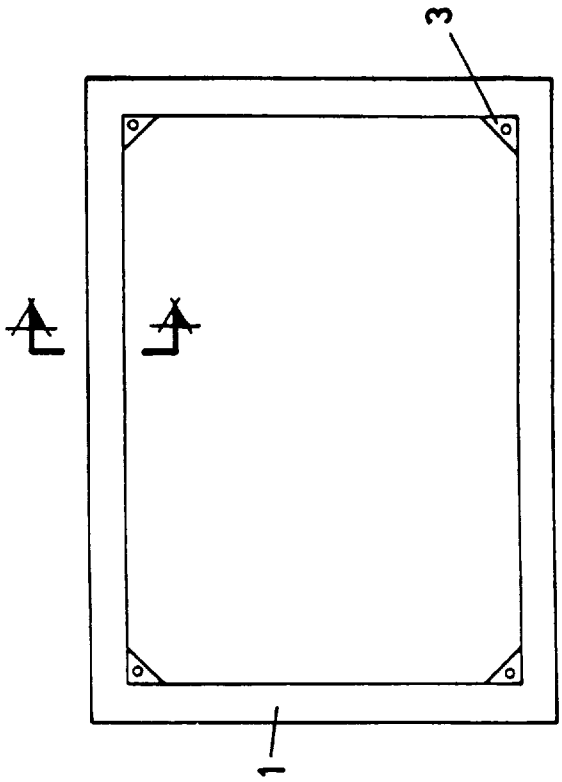
FIG. 1 presents a plan view of the structural frame (1) of the box spring proposed.
Figure 3:
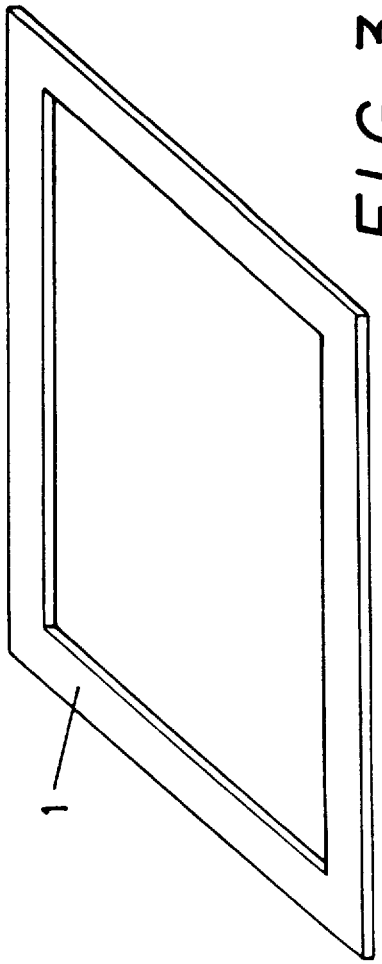
FIG. 3 is a perspective view of the same frame (1) of the box spring, less the corner plates (3).

1. Structural frame.
2. Covering bands.
3. Comer braces.

The subject of the invention is a box spring with a plastic band support for mattresses in beds, the box spring consisting of a frame (1), preferably of shaped tubing of a metal such as steel.

Mounted on this frame (1) is a set of bands (2) of a plastic material mounted individually around the frame (1) so as to enclose the latter. The majority of the bands (2) are mounted transversely so as to form a continuous closed surface, while certain individual bands (2) are interlaced longitudinally to keep the set as it is and aid in forming a uniform fabric; see FIGS. 5 and 7.

These bands (2) are made of a material characterized by increased resistance to deformation and at the same time possessing a certain flexibility; this prevents the surface of the box spring from acquiring a permanent set during use, such as the classic central hollow customarily made in conventional mattresses, in that the support surface for the mattress provides a flexibility which makes use of the mattress more comfortable than do the rigid plates utilized in some cases.

In one embodiment of the invention, which is not restrictive, the bands (2) in question are formed by linear extrusion of polyropylene and have the dimensions of 12 millimeters in width and 0.5 millimeters in thickness, the number of these bands varying in each case with the dimensions of the box spring. Good results are obtained with a box spring made for what is termed a double-sized bed, that is, one measuring 190 centimeters by 140 centimeters, in which the frame (1) is enclosed transversely in approximately 150 bands (2), these bands being interlaced longitudinally with 10 to 12 such bands.

These bands (2) are installed individually, by means of a special machine which places the bands under tension and cuts them, also heat sealing the overlapping ends of each closure, so that a resistance is obtained in the joint which more or less equals that in the remainder of the band.

By way of nonrestrictive example it is stated that the particular characteristics of the bands (2) in question may be a breaking strength ranging from 140 to 160 kilograms and elongation of approximately 4 percent under 50 kilograms of tension.

Such bands (2) are mounted on the frame (1) by application of permanent tension of the order of 15 to 18 kilograms per band (2) on the frame (1), for which reason the latter must be able to withstand constant pressure made up of the sum of the assembly tension stresses of the entire set of bands (2) installed, to which is to be added the supplementary stress applied during use by the weight of the person or persons on the mattress.

Consequently, the frame (1) must consist of a section strong enough to withstand the stresses in question without undergoing deformation.

Corner plates (3) may be provided in the comer areas of the frame (1) itself. In addition to promoting structural rigidity, these corner plates may also be used as anchors for the attachment of leg supports.

As the foregoing data indicate, the frame (1) must withstand through the action of the bands (2) a constant pressure of the order of 2,500 kilograms. To be added to this is the weight of persons resting on the frame, this weight slightly increasing the pressure on the bands (2). Consequently, the frame (1) is designed to withstand a pressure of 3,000 kilograms without undergoing deformation.

In the example of a double bed discussed above, the frame (1) is in the form of structural steel tubing with a cross-section of 100 millimeters by 40 millimeters and a thickness of 2.25 millimeters, as is indicated in FIG. 2. It is obvious that all these data are to be construed as representing a nonrestrictive exemplary embodiment, in that a box spring of any size may be produced for a bed of any type in accordance with the solution proposed, the dimensions and the number of bands (2) being modified accordingly.

I claim:

1. A high-resistance box spring for supporting a mattress, said box spring comprising:

a frame made of tubes, said tubes arranged to form said frame such that said tubes constitute a perimeter for an area on which the mattress would be supported; and a set of separate first plastic bands, each of said first plastic bands being made of a material that is slightly flexible but highly resistant to deformation, each of said first plastic bands being positioned around said tubes in an annular fashion and tightened to a tension of 15 to 18 kilograms so that ends of each of said first plastic bands overlap and the overlapped ends are heat sealed, and each of said first plastic bands is positioned on said frame so that said set of separate first plastic bands completely covers said area for supporting the mattress so as to form a continuous closed surface.

2. A high-resistance box spring for supporting a mattress according to claim 1, further including: a set of separate second plastic bands, each of said second plastic bands being made of a material that is slightly flexible but highly resistant to deformation, each of said second plastic bands being positioned around said tubes in an annular fashion and tightened to a tension of 15 to 18 kilograms so that ends of each of said second plastic bands overlap and the overlapped ends are heat sealed, and each of said second plastic bands further being positioned perpendicular to said set of separate first plastic bands on said frame;

wherein said second plastic bands are interlaced over and under said set of separate first plastic bands to form a continuous closed surface that completely covers said area for supporting the mattress.

3. A high-resistance box spring for supporting a mattress according to claim 2, wherein said first plastic bands and said second plastic bands are 12 millimeters wide and 0.50 millimeters thick, with a rupture resistance of 140 kilograms and a 4 percent elongation when under 50 kilograms of tension and are made of linearly extruded polypropylene.

* * * * *